US006059921A

United States Patent [19]

Kato et al.

[11] Patent Number: 6,059,921

[45] Date of Patent: May 9, 2000

[54] CHEMICAL MECHANICAL POLISHING APPARATUS AND A POLISHING CLOTH FOR A CHEMICAL MECHANICAL POLISHING APPARATUS

[75] Inventors: Nobuhiro Kato; Satoshi Murakami; Tomoharu Watanabe, all of Mie-ken, Japan

[73] Assignee: Kabushiki Kaisha Toshiba, Kawasaki, Japan

[21] Appl. No.: 08/960,199

[22] Filed: Oct. 29, 1997

[30] Foreign Application Priority Data

Oct. 31, 1996 [JP] Japan ..... 8-290397

[51] Int. Cl.[7] ..... B24B 29/00

[52] U.S. Cl. ..... 156/345; 451/443

[58] Field of Search ..... 156/345; 451/443, 451/444

[56] References Cited

U.S. PATENT DOCUMENTS 5,531,635 7/1996 Mogi et al. ..... 451/72

5,857,898 1/1999 Hiyama et al. ..... 451/56

FOREIGN PATENT DOCUMENTS 8-267354 10/1996 Japan .

*Primary Examiner*—Randy Gulakowski
*Assistant Examiner*—Shamim Ahmed
*Attorney, Agent, or Firm*—Banner & Witcoff, Ltd.

[57] ABSTRACT

The present invention provides a CMP apparatus for minimizing the deterioration of the polishing performance and allows easy detection of the its useful operational limit. The CMP apparatus for polishing of the semiconductor substrate is provided with a dresser for removing abrasive grains which have fallen onto the polishing cloth. A particle remover is provided for easily removing abrasive grains at approximately the same time or at a different time as the dressing process. The polishing cloth includes a use limit indicator formed in a concavity of the cloth. Upon the exposure of the use limit indicator, the limit of the polishing cloth can be easily detected.

12 Claims, 4 Drawing Sheets

CHEMICAL MECHANICAL POLISHING APPARATUS AND A POLISHING CLOTH FOR A CHEMICAL MECHANICAL POLISHING APPARATUS

BACKGROUND OF THE INVENTION

1. Field of the Invention

The present invention relates to a chemical mechanical polishing (CMP) apparatus used for manufacturing a semiconductor device and a polishing cloth for use with the apparatus. The invention relates particularly to a CMP apparatus for minimizing deterioration in the polishing performance of the polishing cloth and allows easy detection of its useful operational limit.

2. Description of the Related Art

Today as the number of layers of large scale integrated circuits (LSI) and the density of such circuits increases, the use and development of improved polishing and smoothing techniques for interlayer insulation films becomes critically important. At present, chemical mechanical polishing (CMP) is widely recognized for smoothing and final preparation of a semiconductor wafer.

FIG. 5 shows the general configuration of a CMP apparatus. This apparatus comprises at least a rotatable ring 3 for fixing and rotating a semiconductor substrate 1, a polishing cloth 5 for polishing the surface of the semiconductor substrate 1 and a turntable 7 for fixing and rotating the polishing cloth 5. During the formation of a semiconductor substrate, surface irregularities are usually created which need to be removed. After semiconductor substrate 1 is received, rotatable ring 3 forces surface 1 against cloth 5 and ring 3; turntable 7 is then rotated and abrasive fluid 9 is supplied. As a result, the surface of the semiconductor substrate 1 is smoothed by mechanical polishing and chemical reactions.

For effective polishing, the cloth must have an abrasive quality. The CMP apparatus utilizes a process called dressing to maintain the polishing performance of the polishing cloth. Dressing restores the abrasiveness of a dull polishing cloth. The cloth becomes dull as it is used; its dullness is proportional to the number of times it is used on semiconductor substrates. FIG. 6 shows the operation of a dresser during the dressing process. Dresser 11, containing a diamond granular surface, is pressed against the surface of the polishing cloth 5 fixed to turntable 7; dresser 11 and polishing cloth 5 respectively rotate during the dressing operation. Alternatively, the dresser 11 itself may be moved horizontally in order to completely cover the surface of the polishing cloth.

FIG. 7 is an enlarged view of dresser 11. An abrasive diamond granular surface 13 is formed by a mixture of abrasive diamond grains on an annular region of dresser 11. Diamond grain surface 13 is pressed against the surface of the polishing cloth during the dressing. In accordance with the invention described below, dressing may be performed simultaneously during the semiconductor substrate polishing. Alternatively, it may be performed before or after the substrate polishing.

FIG. 8 is a diagram showing the practical configuration of a general CMP apparatus. The surface of polishing cloth 5 has an abrasive surface comprising, for example, dimples or lattice grooves for distributing an abrasive fluid 9 along the entire surface of polishing cloth 5. As the polishing cloth processes more and more area of substrate 1, the cloth becomes worn and thin. When the wear on the polishing cloth 5 exceeds a particular limit, both the polishing speed and the uniformity of the polishing will deteriorate. Therefore, a test board, made of a sample semiconductor substrate, has been used in the prior art to detect the wear of the cloth; it assists in determining whether it has reached a use limit indicating the cloth is no longer effective for polishing. The polishing speed and the surface polishing uniformity are calculated during this inspection process; accordingly, it can be determined whether the polishing cloth 5 has exceeded its use limit. Upon determining that the cloth has not reached the use limit, the CMP apparatus can then be used to polish substrate 1; polishing cloth 5 is replaced, however, upon exceeding its use limit.

During dressing, abrasive diamond grains may fall off the diamond surface and onto the cloth; as a result, the fallen grains may damage the surface of the semiconductor substrate during subsequent polishing operations. FIGS. 9 is a cross section of the abrasive diamond granular surface 13 shown in FIG. 7. As shown in FIG. 9(*a*), diamond grains 17 are embedded in a nickel layer 19 of surface 13 for dressing the polishing cloth. As shown in FIG. 9(*b*), friction created by the contact of surface 13 and the polishing cloth 5 during dressing causes diamond grains 17 to fall off nickel layer 19 and drop onto cloth 5. As shown, nickel layer 19 becomes thinner as it is scoured during dressing and grains 17 fall from the surface. Some diamonds are more susceptible to loosening and falling because their area contacting nickel layer 19 is small and thereby may be more easily removed during the dressing operation. As a result, diamond grains 17 fall off continuously. The presence of extraneous fallen diamond grains on the polishing cloth will potentially destroy the substrate during the polishing step. In addition, the use of a test board has associated problems. First, the use of test boards necessarily results in a waste of semiconductor substrates since they must be abandoned after their temporary use. Second, since the size of the test board substrate must be commensurate with the semiconductor substrate used in production, the subsequent discarding of the board results in further waste and costs. Further, the time required for test board processing and evaluation is problematic counterproductive in attempting to improve manufacturing efficiency in a production line.

SUMMARY OF THE INVENTION

An object of the present invention is to provide a CMP apparatus which avoids damage to the surface of a semiconductor substrate by removing abrasive grains which have fallen onto the surface of the polishing cloth before actual polishing begins. Another object of the invention is to provide a CMP apparatus and polishing cloth which readily identifies the use limit of a polishing cloth without the need for a test board.

The present invention provides a dresser in a chemical mechanical polishing apparatus comprising a surface facing a semiconductor substrate, an annular abrasive grain surface on the periphery of the surface, and a particle remover located within an area surrounded by the annular abrasive grain surface.

The present invention provides a chemical mechanical polishing apparatus comprising a rotatable ring for holding a semiconductor substrate, a polishing cloth on a turntable, facing the semiconductor substrate, a dresser adjacent the rotatable ring and the facing polishing cloth. The dresser also includes an abrasive grain annulus; and a particle remover surrounded by the abrasive grain annulus.

The present invention provides a method for removing abrasive grains on a polishing cloth in a CMP apparatus having a rotatable ring for receiving a semiconductor substrate, a polishing cloth on a turntable facing the rotatable ring, a dresser adjacent the rotatable ring and facing the polishing cloth; the dresser having an abrasive grain annular surface and a particle remover surrounded by the abrasive grain annular surface. The method comprising the steps of dressing the polishing cloth, and removing abrasive grains on the polishing cloth while performing the dressing step.

The present invention provides a polishing cloth for a CMP apparatus comprising a polishing cloth and a concavity on the polishing cloth for holding a use limit indicator.

The present invention provides a CMP apparatus comprising a rotatable ring for receiving a semiconductor substrate, a polishing cloth on a turntable facing the rotatable ring, and a concavity on the polishing cloth for holding a use limit indicator.

The present invention provides a method for detecting a use limit of the polishing cloth in a CMP apparatus, comprising the step of detecting a use limit indicator embedded in a concavity on a polishing cloth.

DETAILED DESCRIPTION OF THE PREFERRED EMBODIMENTS

Figure 1:
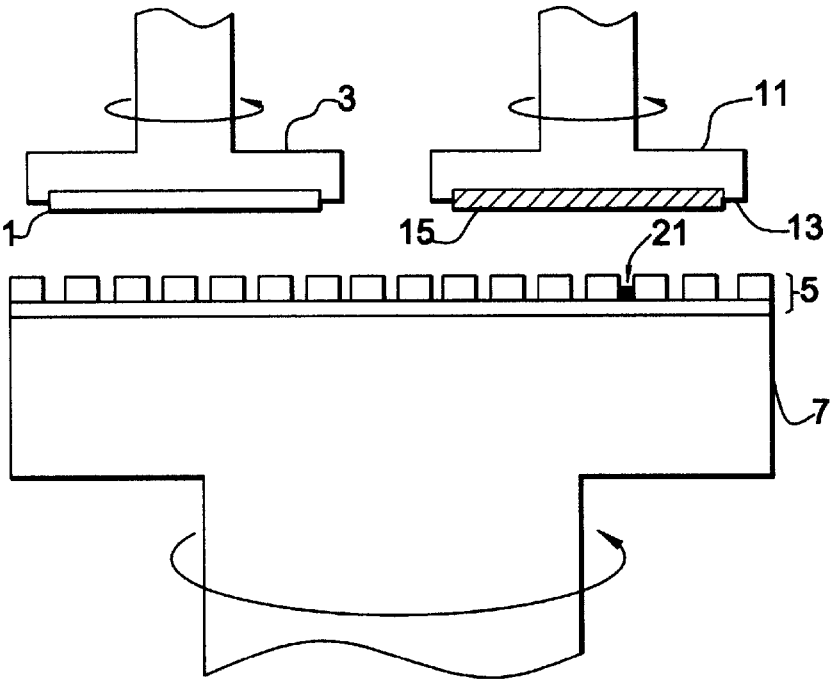
FIG. 1 shows a general configuration of a CMP apparatus according to an embodiment according to the present invention.

FIG. 1 shows a general configuration of a CMP apparatus according to the present invention. The components shown in FIGS. 5–9 are provided with the same reference numerals. The CMP apparatus comprises a rotatable ring 3 which receives, holds and rotates a semiconductor substrate 1; facing substrate 1 is a polishing cloth 5 for polishing the surface of semiconductor substrate 1 and a turntable 7 which receives, holds and rotates polishing cloth 5. The surface of semiconductor substrate 1, which has surface irregularities after the manufacturing processes, is pressed against polishing cloth 5. Ring 3 and turntable 7 are rotated while being supplied with abrasive fluid 9. The surface of semiconductor substrate 1 is thereby smoothed due to the mechanical polishing and the concomitant chemical reactions. Positioned adjacent semiconductor substrate 1 is a diamond dresser 11. Diamond dresser 11 is pressed against the surface of polishing cloth 5, and is rotated for restoring the abrasiveness of polishing cloth 5 during rotation of polishing cloth 5. This restoring step is needed to maintain the polishing performance of cloth 5 since it will become dull as a number of semiconductor substrates are treated over time.

Figure 2:
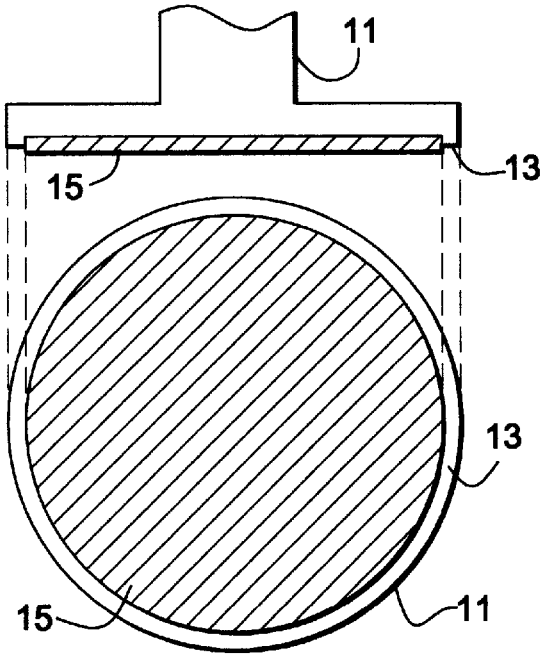
FIG. 2 is an enlarged view of the diamond dresser shown in FIG. 1.

FIG. 2 is an enlarged view of the diamond dresser 11 shown in FIG. 1. The components shown in FIGS. 5–9 are provided with the same reference numerals. Diamond dresser 11 according to the present invention comprises an abrasive annulus 13 (e.g., diamond granular) and a particle remover 15 comprising material for mechanically removing particles, such as abrasive diamond grains that fall onto the polishing cloth. Particle remover 15 comprises a nylon brush positioned concentrically within the abrasive annular surface 13. Since particle remover 15 removes the abrasive grains that have fallen onto the polishing cloth during dressing or moves them to an area not used for polishing, the semiconductor surface can be kept free from flaws caused by loose abrasive grains. Alternatively, some abrasive grains are removed from the surface of the cloth because they adhere to the brush. Since the diamond dresser incorporates a remover, diamond grains can be removed at the same time as dressing is performed. Therefore, remover 15 can reduce the total processing time because no additional time is required to remove any loose grains.

Remover 15 may also comprise a sponge or a mohair brush. When using a mohair brush good particular removal can be obtained since no additional pressure is required; a mohair brush is softer than using a nylon brush. It is desirable that the remover have a diameter at least as large as the diameter of semiconductor substrate 1. When diamond dresser 11 is swung into position during the dressing process, the remover needs to have at least a diameter which is sufficient for contacting the entire area used for polishing. This will allow more effective removal of the loose abrasive grains. According to the present invention, dresser 11 can remove the abrasive grains that have fallen onto the polishing cloth 5 at the same time as the dressing operation is performed. This reduces both processing time and cost.

Figure 3A:
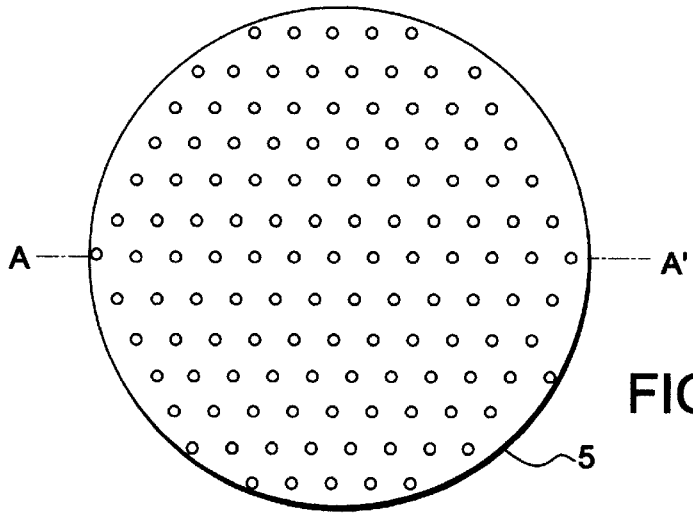
FIGS. 3(*a*) and 3(*b*) are enlarged views of the polishing cloth shown in FIG. 1.
Figure 3B:
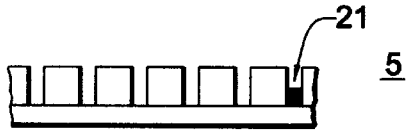

FIG. 3 is an enlarged view of the polishing cloth 5 of FIG. 1. FIG. 3(*a*) is a plan view and FIG. 3(*b*) is a partial cross sectional view taken along line A–A'. The parts contained in the FIGS. 5–9 are provided with the same reference numerals. Polishing cloth 5, according to the present invention, has concavities on the surface, such as dimples or lattice grooves. In addition to its uniform standard concavities, polishing cloth 5 has at least one shallow concavity. This shallow concavity is used as a use limit indicator 21. As cloth 5 becomes thinner while treating more and more semiconductor substrates 1, use limit indicator 21 gradually appears to approach the surface. By visually checking this indicator, the use limit of the polishing cloth 5 can be easily detected. Therefore, the need for the prior art test polishing process and test boards become unnecessary. Consequently, both processing time and cost are reduced. Use limit indicator 21 can be easily fabricated since it is made, in part, from the same material as polishing cloth 5. For example, indicator 21 may be provided by embedding a different material in a shallow concavity of polishing cloth 5.

Figure 4A:
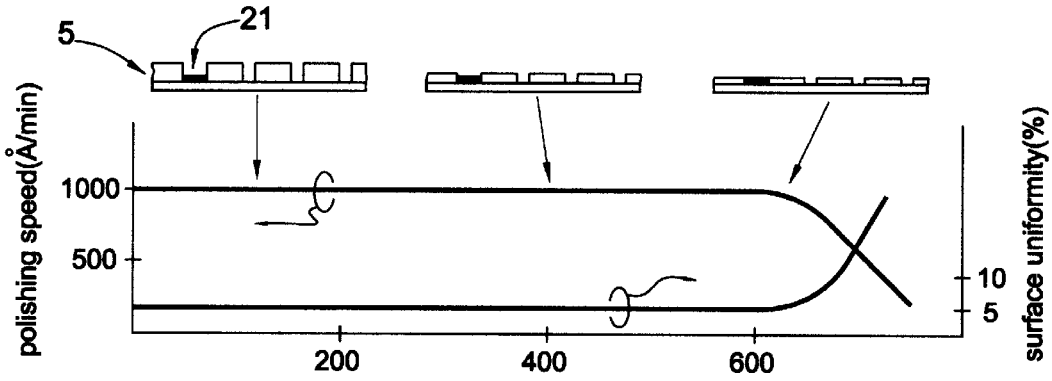
FIGS. 4(*a*) and 4(*b*) are diagrams showing the results of actual polishing using the polishing cloth of FIG. 3.
Figure 4B:
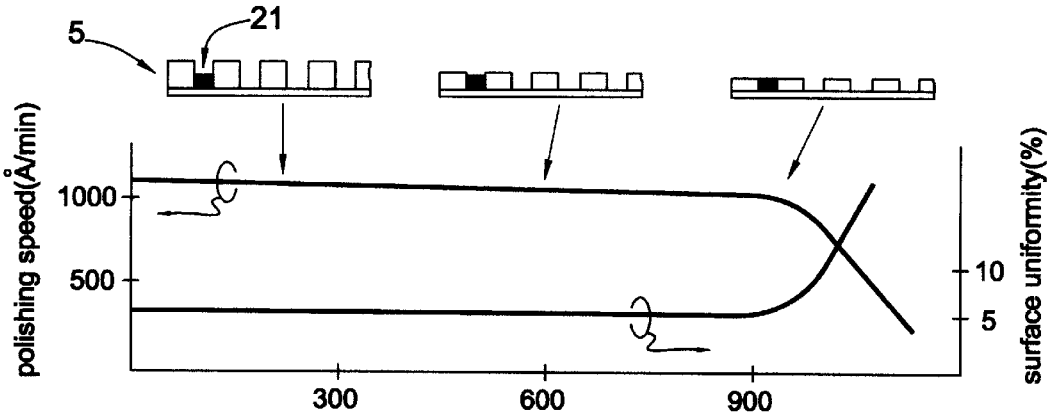
Figure 5:
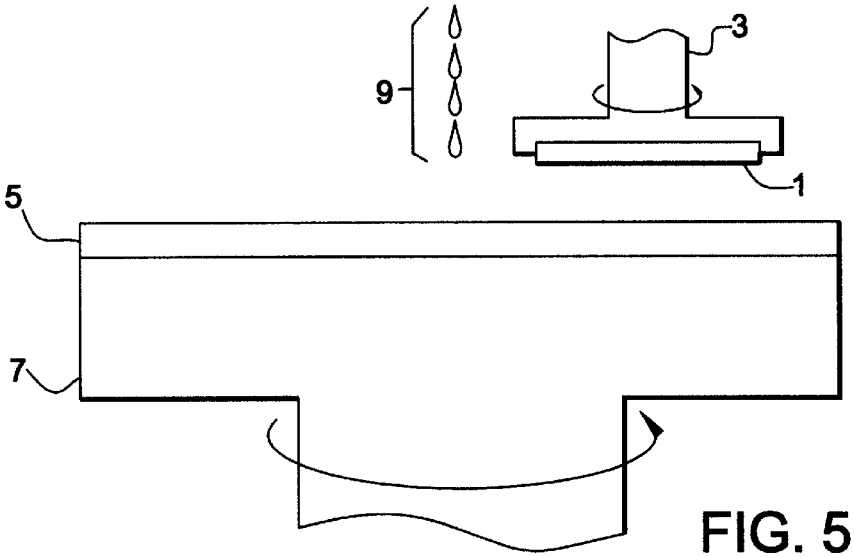
FIG. 5 PRIOR ART
FIG. 5 shows the configuration of a general CMP apparatus.
Figure 6:
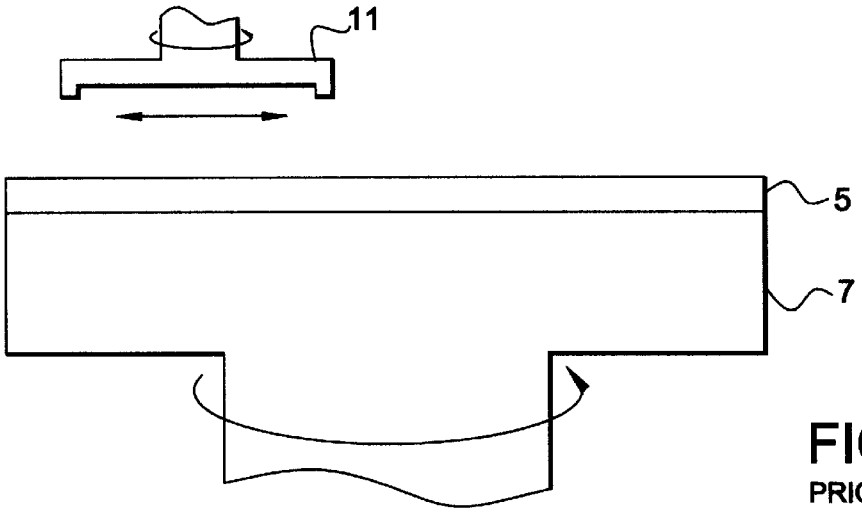
FIG. 6 PRIOR ART
FIG. 6 shows the diamond dresser and the polishing cloth during a dressing operation.
Figure 7:
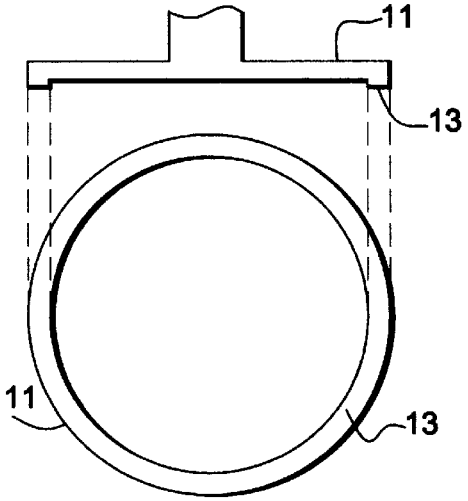
FIG. 7 PRIOR ART
FIG. 7 is an enlarged view of the diamond dresser shown in FIG. 6.
Figure 8:
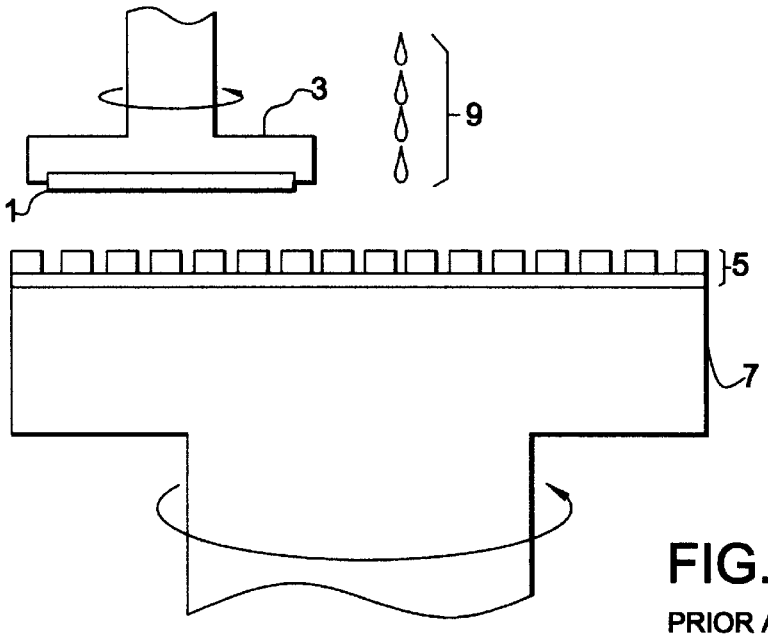
FIG. 8 PRIOR ART
FIG. 8 shows the configuration of another general CMP apparatus.
Figure 9A:
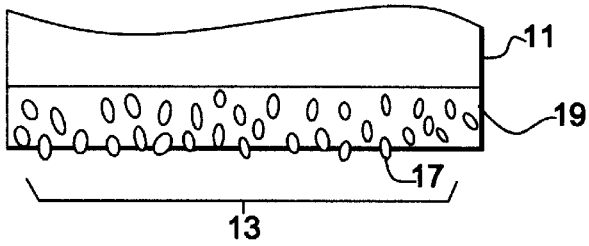
FIG. 9(a) PRIOR ART
FIGS. 9(*a*) and 9(*b*) are cross sectional views of the abrasive grain surface shown in FIG. 7.
Figure 9B:
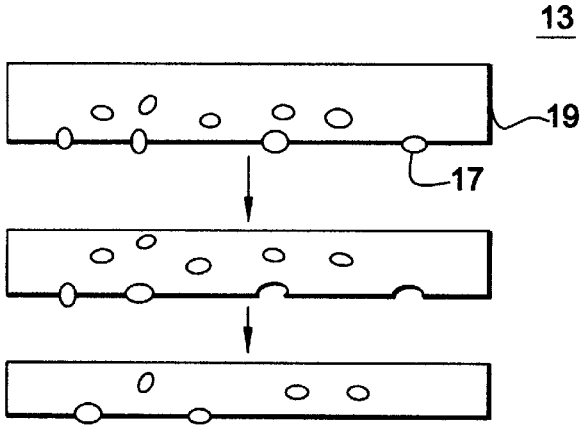
FIG. 9(b) PRIOR ART

FIG. 4 are diagrams showing the actual polishing results of the semiconductor substrate using the polishing cloth 5 of FIG. 3. FIG. 4(*a*) shows the polishing results of a semiconductor substrate deposited with an oxide film having a thickness of 0.6 $\mu$m and FIG. 4(*b*) shows the polishing results of a semiconductor substrate deposited with a polysilicon film having a thickness of 0.5 $\mu$m. In FIGS. 4(*a*) and 4(*b*), the horizontal axis indicates the number of polished semiconductor substrates and the vertical axis shows the polishing speed and the surface polishing uniformity. Polishing cloth 5 is made of polyurethane with a thickness of about 1.3 $\mu$m and use limit indicator 21 has a thickness of 0.5 $\mu$m. As shown in FIG. 4(*a*), when a silicon substrate has a 0.6 μm thick oxide film, the polishing speed declines and the surface polishing uniformity deteriorates rapidly after the polishing cloth 5 has polished approximately 600 substrates. At this time, the use limit indicator 21 can be used (as shown) to easily detect that the polishing cloth 5 must be replaced. And, as shown in FIG. 4(*b*), when a silicon substrate has a 0.5 μm thick polysilicon film, the polishing speed declines and the surface polishing uniformity deteriorates rapidly when the cloth has polished approximately 900 semiconductor substrates. At this time, the use limit indicator 21 can also be used (as shown) to detect that the polishing cloth 5 must be replaced. As described, the use limit indicator on polishing cloth 5 can be easily detected without the need for conventional test polishing steps. Therefore, the use of test boards which are later discarded become unnecessary and a shorter processing time is obtained while reducing overall processing costs.

In the above description, the material of the polishing cloth 5 is described to be polyurethane, however, the present invention can be applied to all polishing cloth materials used for polishing semiconductor substrates. For example, nylon or rayon can also be used. The use limit indicator 21 is designed to have a thickness so that it visually appears on the polishing cloth surface at the point when the polishing speed and/or the surface polishing uniformity deteriorates. In the above description, the use of silicon substrates deposited with an oxide film and/or polysilicon film has been described, the present invention may also be applied to the polishing of film forming materials generally used in the LSI processes such as high melting point metals (including for example, Si, Mo, W, Ti, and Ta) and their oxides, nitrides and suicides, as well as metal wiring materials (including for example, Al, Cu, Al—Si—Cu and Al—Cu).

While a presently preferred embodiment of the invention has been described, those of ordinary skill in the art will be enabled to contemplate variations from the information given in the disclosure. Such variations are intended to fall within the scope of the present invention. Such variations may be made in the structure of the various parts and methods without functionally departing from the spirit of the invention. For example, the dressing and polishing steps can be carried out simultaneously. In addition, while the dresser and particle remover are shown on one integral structure, they may be separated. In that case, the particle removing operation can be performed during or after the dressing operation. Further, while the dresser has an annular shape and operates with circular motion, other shapes are contemplated with other motions such as, for example, a series of horizontal movements. In that case, the particular remover will then brush the surface in one of a number of pattern movements to cleanse abrasive particles from the polishing cloth.

What is claimed is:

1. A dresser for use with a chemical mechanical polishing apparatus in fabricating a semiconductor substrate comprising:

an annular region;

an abrasive surface on the annular region; and a particle remover comprising a brush located within an area surrounded by the annular region.

2. A dresser according to claim 1, wherein the brush comprises nylon.

3. A dresser according to claim 1, wherein the brush comprises mohair.

4. A dresser according to claim 1, wherein the diameter of the particle remover is larger than the semiconductor substrate being fabricated.

5. A chemical mechanical polishing apparatus comprising:

a rotatable ring for holding a semiconductor substrate;

a polishing cloth positioned on a turntable;

a dresser, positioned facing the polishing cloth, having an abrasive annular surface; and a particle remover comprising a brush positioned concentrically with respect to the abrasive annular surface.

6. A chemical mechanical polishing apparatus according to claim 5, wherein the particle remover comprises a nylon brush.

7. A chemical mechanical polishing apparatus according to claim 5, wherein the particle remover comprises a mohair brush.

8. A chemical mechanical polishing apparatus according to claim 5, wherein the diameter of the particle remover is larger than the semiconductor substrate.

9. A dresser for use with a chemical mechanical polishing apparatus in fabricating a semiconductor substrate comprising:

an annular region;

an abrasive surface on the annular region; and a particle remover comprising a sponge located within an area surrounded by the annular region.

10. A dresser according to claim 9, wherein the diameter of the particle remover is larger than the semiconductor substrate being fabricated.

11. A chemical mechanical polishing apparatus comprising:

a rotatable ring for holding a semiconductor substrate;

a polishing cloth positioned on a turntable;

a dresser, positioned facing the polishing cloth, having an abrasive annular surface; and a particle remover comprising a sponge positioned concentrically with respect to the abrasive annular surface.

12. A dresser according to claim 11, wherein the diameter of the particle remover is larger than the semiconductor substrate being fabricated.

* * * * *